US005255965A

United States Patent [19]

Chen et al.

[11] Patent Number: 5,255,965

[45] Date of Patent: Oct. 26, 1993

[54] WATERPROOF STEREO COVER ASSEMBLY WITH HINGE PROVIDING MULTIPLE STOP POSITIONS

[75] Inventors: Ting P. Chen, 7th Fl.-1, No. 129, Sec. 2, Hsinhai Rd., Taipei; Chao L. Lin, Taichung, both of Taiwan

[73] Assignee: Ting P. Chen, Taipei, Taiwan

[21] Appl. No.: 834,776

[22] Filed: Feb. 13, 1992

[51] Int. Cl.[5] ..... A47B 81/06; E05D 11/10

[52] U.S. Cl. ..... 312/7.1; 312/328; 16/260; 16/334

[58] Field of Search ..... 312/7.1, 296, 328, 223.1; 16/386, 260, 379, 334; 49/279, 388

[56] References Cited

U.S. PATENT DOCUMENTS

| | | | |
|---|---|---|---|
| 3,000,049 | 9/1961 | Terry | 16/334 |
| 3,352,613 | 11/1967 | Morris | 312/328 |
| 4,536,005 | 8/1985 | Tanaka | 16/334 |
| 4,734,955 | 4/1988 | Connor | 16/334 |
| 4,974,289 | 12/1990 | Piard | 16/334 |
| 5,068,765 | 11/1991 | Nimpoeno | 16/334 |
| 5,109,572 | 5/1992 | Park | 16/334 |

FOREIGN PATENT DOCUMENTS

| | | | |
|---|---|---|---|
| 1909445 | 9/1969 | Fed. Rep. of Germany | 16/334 |
| 2558512 | 7/1985 | France | 16/260 |

*Primary Examiner*—Peter M. Cumomo
*Assistant Examiner*—Flemming Saether
*Attorney, Agent, or Firm*—W. E. Pelton

[57] ABSTRACT

A waterproof stereo cover assembly includes a stereo-mounting frame for mounting a stereo therein, a waterproof cover pivotally attached to the stereo-mounting frame, and sealing members mounted in the stereo-mounting frame for sealing the stereo-mounting frame. The stereo-mounting frame has a notch formed on and extending lengthwise along an upper frame thereof, defining two end walls. A polygonal socket is symmetrically formed in each of the two end walls of the notch. A slot having a width slightly less than that of the polygonal socket extends from each polygonal socket to a front side of the stereo-mounting frame. The waterproof cover has a flange extending on an upper edge thereof, being received in the notch. The flange has a polygonal stub protruding from each of two side walls thereof which is dimensioned corresponding to the polygonal sockets, so as to be pivotally received in the polygonal sockets, thereby optionally retaining the waterproof cover in a pre-set position pursuant to angular positions of the polygonal stubs.

1 Claim, 2 Drawing Sheets

WATERPROOF STEREO COVER ASSEMBLY WITH HINGE PROVIDING MULTIPLE STOP POSITIONS

BACKGROUND OF THE INVENTION

The present invention relates to a waterproof cover assembly for stereos and, more particularly, to an improved waterproof cover assembly for stereos used on yachts.

Conventional stereos used on yachts or the like require a waterproof cover to protect the stereos from being splashed and thus damaged by water. However, conventional stereo waterproof covers have several drawbacks: they either provides inefficient sealing or are cumbersome in assembly.

Therefore, there has been a long and unfulfilled need for an improved waterproof stereo cover assembly used on yachts which provides improved sealing and can be easily assembled.

SUMMARY OF THE INVENTION

According to one aspect of the present invention, a waterproof stereo cover assembly includes a stereo-mounting frame for mounting a stereo therein and a waterproof cover pivotally attached to the stereo-mounting plate.

The stereo-mounting frame has a notch formed on and extending lengthwise along an upper frame thereof. A hexagonal socket is symmetrically formed in each of two end walls of the notch. A slot having a width slightly less than that of the hexagonal socket extends from each hexagonal socket to a front side of the upper frame of the stereo-mounting frame.

The waterproof cover has a flange extending on an upper edge thereof. The flange is dimensioned to be fittingly received in the notch and has a hexagonal stub protruding from each of two side walls thereof. The stubs are dimensioned corresponding to that of the hexagonal socket, so as to be pivotally received in the hexagonal sockets, thereby optionally frictionally retaining the waterproof cover in one of a number of pre-set positions pursuant to angular positions of the hexagonal stubs.

It is an object of the present invention to provide an easily-assembled waterproof cover assembly.

It is another object of the present invention to provide a waterproof stereo cover which can be optionally and frictionally retained in two or more positions.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
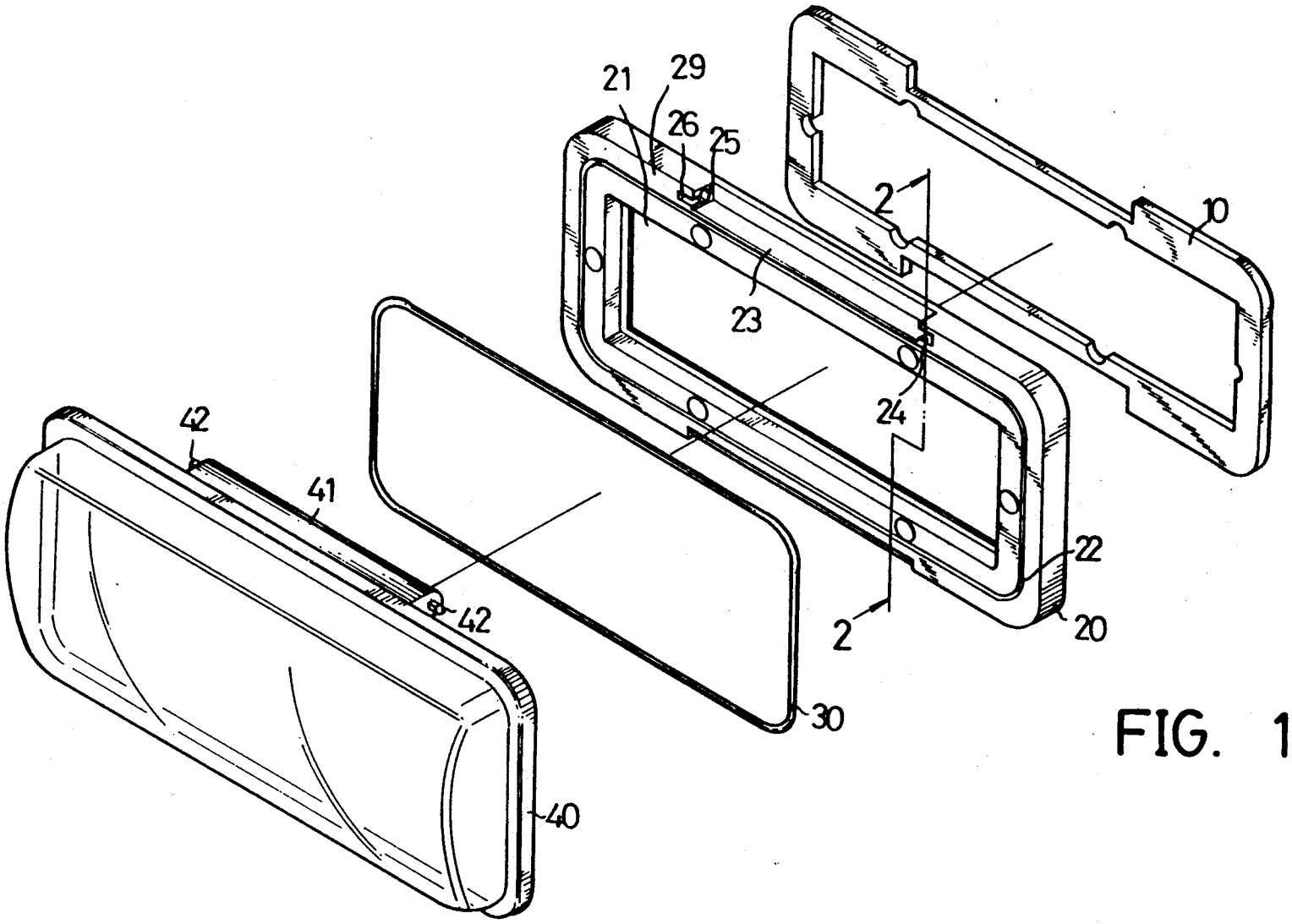
FIG. 1 is an exploded view of a waterproof stereo cover assembly in accordance with the present invention.
Figure 2:
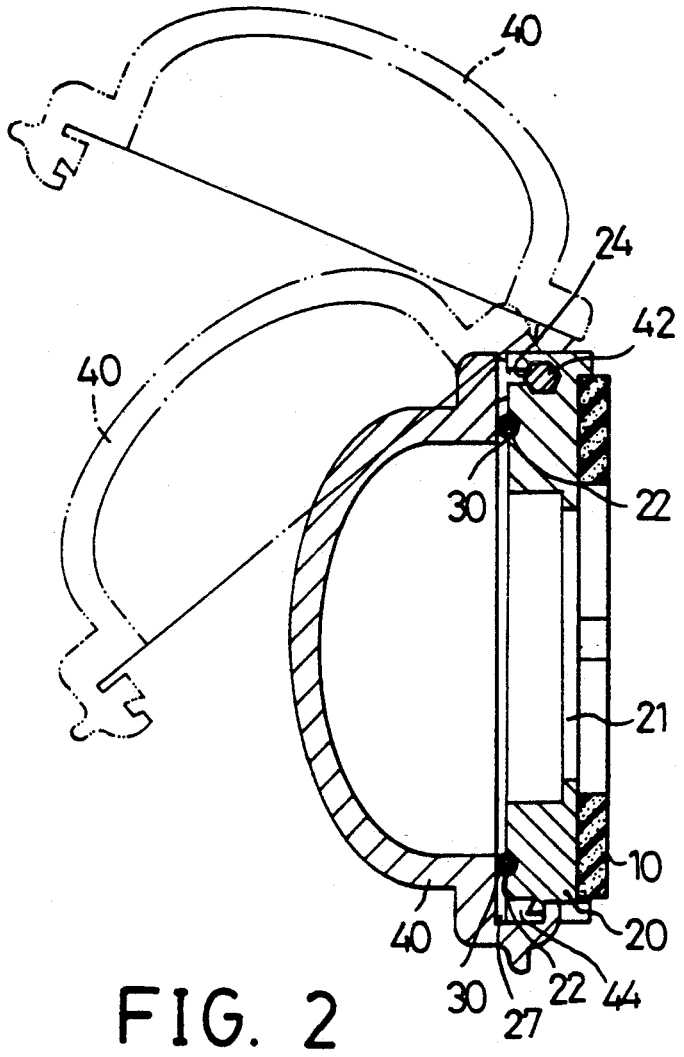
FIG. 2 is a cross-sectional view taken along line 2—2 in FIG. 1, showing a structure and operation of the waterproof stereo cover assembly in accordance with the present invention.

Referring to FIGS. 1 and 2 of the drawings, a waterproof stereo cover assembly in accordance with the present invention includes a stereo-mounting frame 20 and a waterproof cover 40 pivotally attached to the stereo-mounting frame 20. As well-known in the art, the stereo-mounting frame has a central opening 21 through which a stereo (not shown) is securely mounted. Also known in the art is that a sealing gasket 10 and a sealing ring 30 are respectively provided in a rear channel (not labeled) formed in the rear side and a front channel 22 formed in a front side of the stereo-mounting frame to prevent water from entering.

The present invention is characterized in that the stereo-mounting frame 20 has a notch 23 formed on and extending lengthwise along an upper frame 29 thereof. A polygonal socket, such as a hexagonal socket 25, is symmetrically formed in each of two end walls of the notch 23. A slot 26 having a width slightly less than that of the hexagonal socket 25 extends from each hexagonal socket 25 to a front side of the stereo-mounting frame 20.

The waterproof cover 40 has a flange 41 extending on an upper edge thereof. The flange 41 is dimensioned to be fittingly received in the notch 23 and has a hexagonal stub 42 protruding from each of two side walls thereof. Each stub 42 is dimensioned corresponding to that of the hexagonal socket 25, so as to be pivotally received in the hexagonal sockets 25, thereby optionally and frictionally retaining the waterproof cover 40 in one of three pre-set positions pursuant to angular positions of the hexagonal stubs 42 by means of the frictional force existing between the hexagonal sockets 25 and the hexagonal stubs 42.

When assembling, the waterproof cover is easily attached to the stereo-mounting frame 20 by inserting one of the hexagonal stubs 42 into the corresponding hexagonal socket 25 along the longitudinal direction of the stereo-mounting frame and then inserting the other hexagonal stub 42 into the other hexagonal socket 25 via the corresponding slot 26.

In use, the waterproof cover 40 can be optionally and frictionally retained in three positions due to the provisions of the hexagonal sockets 25 and the hexagonal stubs 42, as clearly shown by the solid lines and phantom lines representing the waterproof cover 40 in FIG. 2, providing a further advantage when using the waterproof cover 40. When the waterproof cover 40 is in its lowermost position, a hook means 44 provided at a bottom of the waterproof cover 40 releasably yet securely engages with an engaging edge 27 formed in a bottom side of the stereo-mounting frame 40, thus sealing the stereo, which is conventional and needs no further explanation.

Although the invention has been explained in relation to its preferred embodiment, it is to be understood that many other possible modifications and variations can be made without departing the spirit and scope of the invention as hereinafter claimed.

I claim:

1. A waterproof stereo cover comprising a stereo-mounting frame for mounting a stereo therein, a waterproof cover pivotally attached to said stereo-mounting frame, and sealing means mounted in said stereo-mounting frame for sealing said stereo-mounting frame, the improvement comprising: said stereo-mounting frame having a notch formed in and extending lengthwise along an upper frame thereof, defining two end walls, a polygonal socket being symmetrically formed in each of said two end walls of said notch, a slot having a width slightly less than that of said polygonal socket extending from each said polygonal socket to a front side of said upper frame, said waterproof cover having a flange extending on an upper edge thereof, being dimensioned to be fittingly received in said notch, said flange having a polygonal stub protruding from each of two side walls thereof, being dimensioned corresponding to said polygonal sockets so as to be pivotally received in said polygonal sockets and to optionally and frictionally retain said waterproof cover in one of a number of pre-set positions pursuant to angular positions of said polygonal stubs by means of a frictional force existing between said polygonal sockets and said polygonal stubs.

* * * * *